US009500032B2

(12) United States Patent
Boike

(10) Patent No.: US 9,500,032 B2
(45) Date of Patent: Nov. 22, 2016

(54) TRANSMITTER HOUSING AND METHOD FOR MEASURING A FLUID PRESSURE

(71) Applicant: TRACTO-TECHNIK GmbH & Co. KG, Lennestadt (DE)

(72) Inventor: Volker Boike, Lennestadt (DE)

(73) Assignee: TRACTO-TECHNIK GmbH & Co. KG, Lennestadt (DE)

( * ) Notice: Subject to any disclaimer, the term of this patent is extended or adjusted under 35 U.S.C. 154(b) by 149 days.

(21) Appl. No.: 14/253,390

(22) Filed: Apr. 15, 2014

(65) Prior Publication Data

US 2014/0318233 A1 Oct. 30, 2014

(30) Foreign Application Priority Data

Apr. 15, 2013 (DE) ..... 10 2013 006 342

(51) Int. Cl.

| | |
|---|---|
| ***E21B 47/06*** | (2012.01) |
| ***E21B 7/04*** | (2006.01) |
| ***E21B 7/20*** | (2006.01) |

(52) U.S. Cl.
CPC ..... *E21B 7/046* (2013.01); *E21B 7/20* (2013.01); *E21B 47/06* (2013.01)

(58) Field of Classification Search
CPC ..... E21B 7/046; E21B 7/20; E21B 47/06; E21B 47/01; E21B 47/011
USPC ..... 73/152.22, 152.46; 166/250.11
See application file for complete search history.

(56) References Cited

U.S. PATENT DOCUMENTS

| | | | | |
|---|---|---|---|---|
| 3,744,307 A * | 7/1973 | Harper | ..... | E21B 47/06 73/152.51 |
| 6,487,901 B1 * | 12/2002 | Keyes | ..... | E21B 47/01 73/152.46 |
| 2012/0181044 A1 * | 7/2012 | Nikiforuk | ..... | E21B 7/20 166/374 |

* cited by examiner

*Primary Examiner* — John Fitzgerald
(74) *Attorney, Agent, or Firm* — Howard IP Law Group

(57) ABSTRACT

A transmitter housing for a drilling device having a drilling fluid feed line comprises a collector space formed in the interior of the transmitter housing for accommodating a pressure sensor of a locating probe.

11 Claims, 1 Drawing Sheet

TRANSMITTER HOUSING AND METHOD FOR MEASURING A FLUID PRESSURE

FIELD OF THE INVENTION

The invention relates to a transmitter housing of an auger device and a method for measuring a fluid pressure in a drilling channel. In particular, the invention relates to a transmitter housing for HDD (Horizontal Directional Drilling).

BACKGROUND

In horizontal drilling technology, the obstacles in front of the drill head of the drilling device represent a problem. These types of obstacles may be, for example, hard rock fragments that often cannot be demolished by the drilling devices being used. Furthermore, there may also be water lines, gas lines, telephone lines, and/or electrical lines in the ground close to the surface that must not be destroyed by drilling.

This problem has led to the development of controlled horizontal drilling devices. With these types of drilling devices, characterized as HDD, it is possible to bypass obstacles. The process of obstacle locating via geo-radar exploration is known in order to bypass the obstacles due to the locating.

Normally, the drill head of a horizontal drilling device is the most greatly loaded component, because it is used to transfer the static and dynamic (if there is a percussive device) drilling forces, generated by a drive unit on the horizontal drilling device, to the ground. The drill head is attached on the foremost end of a drill pipe, in which the drill pipe usually consists of a plurality of linkages, connected to one another, for example, via screw closures. The rear end of the drill pipe may be connected to a drive unit, by means of which forces may be transferred to it in the longitudinal direction of the drill pipe, as well as a torque. The drill pipe, including the drill head attached to it, may be driven in the direction of thrust and retraction, as well as rotationally, by means of the drive unit.

The drill head may be a so-called controlled drill head whose front surface, at least in certain areas, is tilted with respect to its own longitudinal axis and, consequently, with respect to the drilling device.

When ground drilling with drilling fluid (flushing fluid), one problem that occurs is so-called "blowouts." If the drilling channel has collapsed, for example, or if there is not sufficient backflow of a drilling fluid being used, along the drilling channel, for other reasons, the pressure in the drilling channel will increase. If this pressure increase in the drilling channel is not detected, this can lead to an uncontrolled blowout of drilling fluid at the surface, which can lead to environmental contamination. There can also be rises or depressions in the ground which means that, for example, roads and parts of buildings may rise up or sink. Therefore, it is desirable to measure the pressure in the drilling channel.

SUMMARY

The object of the invention is therefore to create a transmitter housing of a drilling device with a drilling fluid feed line and/or a method for measuring a fluid pressure in a drilling channel with which, in addition to the locating, the measuring of the pressure in the drilling channel would be simplified and relatively precise.

The object is achieved by the subject matter of the independent claims. Advantageous embodiments are the subject matter of the dependent claims.

The core of the invention is to design a transmitter housing such that, in addition to locating, meaning determining the location and/or position of the transmitter housing, a pressure measurement of the pressure in the drilling channel is also possible. This is to be done primarily with special consideration for the harsh conditions occurring in the ground and particularly in the HDD area.

The core of the invention is to provide a transmitter housing of a drilling device in which the drilling device has a drilling fluid feed line, particularly for flushing fluid. The interior of the transmitter housing has a collection space for a pressure sensor of a locating probe. This is to detect a pressure increase in the drilling channel. The pressure in the drilling channel can thus be checked by an operator and/or automatically. This means that suitable measures can be undertaken, initiated automatically and/or by an operator, when the pressure in the drilling channel increases. Preferably, the locating probe may be designed in a single unit with the pressure sensor. Particularly preferably, the value of the pressure determined via the pressure sensor may be transmitted to the ground surface via a wireless transmitter. The pressure sensor, the locating probe, and the transmitter to transmit the measured values may preferably be designed as a single unit. The transmitter housing may preferably have slots in the area of the transmitter for wireless transmission of the measured values. It is possible for the signal of the pressure sensor to also be used as a signal for the locating probe. The pressure sensor may be a part of the locating probe, in which case the term "locating probe" comprises an electronic device that may be designed as a transmitter. There may be (part) identity between the locating probe and the pressure sensor if, for example, the signal of the pressure sensor is being used as the signal for the locating. The electronic device may emit a signal, which may particularly be present in the form of electromagnetic waves.

In a preferred embodiment, there is a solid matter filter between the exterior compartment of the transmitter housing and the collection space. This will allow the fluid in the drilling channel to be routed to the pressure sensor without any pressure loss or contamination. The drilling debris that is in the flushing fluid cannot reach the interior of the transmitter housing due to the solid matter filter.

Preferably, the collection space is separate from the drilling fluid feed line in order to not influence the pressure sensor due to drilling fluid being fed in. The pressure sensor can thus primarily measure the pressure in the drilling channel. The drilling fluid can escape into the drilling channel at the drill head, without influencing the pressure sensor. The pressure sensor can thus obtain the pressure information from the drilling channel into which the drilling fluid is flowing, but not until the drilling fluid has flowed into the drilling channel.

In a preferred embodiment, the collection space extends in the direction of the longitudinal axis of the transmitter housing, which leads to an optimized utilization of the volume of the transmitter housing. A (wireless) transmitter transmitting the values of the pressure sensor can transmit, in the present case in parallel, due to the arrangement with a defined position with respect to longitudinal axis of the transmitter housing. The collection space may preferably be extended longitudinally. The longitudinal axis of the collection space may lie essentially parallel with respect to longitudinal axis of the transmitter housing. The collection space may, at least partially, have an edge-side border, which may be rotationally symmetric in the direction of a longitudinal axis of the collection space. The collection space may particularly be adapted to the outer dimensions of a pressure sensor.

In a preferred embodiment, a channel is provided from the exterior compartment to the collection space, which has at least one section forming an angle to the longitudinal axis of the transmitter housing that is greater than 0° and less than 180°. This enables the available space to be better utilized. The blades and/or inserts provided at the front on the drill head may be left, as is customary; the channel may be routed independently of the drill head. A particular provision may be that the channel comprise a section having an angle to the longitudinal axis of the transmitter housing that is greater than 60° and less than 120°. In particular, the angle of the section to the longitudinal axis of the transmitter housing forms an angle of 90°. The opening of the channel from the exterior compartment into the transmitter housing is formed spaced apart from the blades of the drill head, particularly from an outlet for the drilling fluid from the drill head, in the direction of the longitudinal axis of the transmitter housing.

In a preferred embodiment, the collector has an inlet opening that is sealed with at least one seal on the edge side such that a pressure surface of the pressure sensor is surrounded by the seal. This arrangement means that the fluid in the exterior compartment is only transferred to the pressure sensor, particularly having the pressure surface. Interior components of the transmitter housing will thus not be contacted by the drilling fluid or the fluid entering from the exterior compartment.

It may be provided that the collector space has a passage on an end opposite the inlet opening having a fluid connection with the exterior compartment. A rod-shaped element, for example, may be inserted through the passage that can be used to drive out a jammed probe. The rod-shaped elements may be a smooth rod or a rod with thread (a threaded rod).

In a preferred embodiment, the passage has an inner thread that is preferably adapted to the outer thread of a closure that can be used to close off the passage. The thread of the passage may also be adapted to the thread of the threaded rod that can be used to drive out the pressure sensor.

In a preferred embodiment, the transmitter housing has a non-return valve on the end that only allows the flow of fluid in the direction toward a drill head. This ensures that the pressure in the drilling channel does not drop during a rod change. While the rods and/or rod linkages are being disassembled, the non-return valve can ensure that the drilling fluid cannot flow through the rods uninhibited, and out of any disassembled rods. This ensures that the pressure in the drilling channel does not drop during a rod change. A reduction in pressure may suggest that a sufficient backflow is ensured for the drilling fluid, which could lead to a malfunction.

In a preferred embodiment, the transmitter housing is located behind the drill head so that the transmitter housing has a connection for a drill head.

The invention also provides for a method to measure a fluid pressure in a drilling channel in which the fluid pressure in the drilling channel is measured with a pressure sensor in a transmitter housing via a fluid connection to the drilling channel.

Preference is given when the fluid connection is sealed such that no inner component has contact with the fluid from the fluid connection.

The aforementioned embodiments, just as the following description of exemplary embodiments, do not represent any omission of certain embodiments or features.

BRIEF DESCRIPTION OF THE FIGURES

The invention is explained in greater detail in the following by means of an exemplary embodiment shown in the drawings.

The drawings show the following.

DETAILED DESCRIPTION

Figures 1, 2, 3, 4, 5:
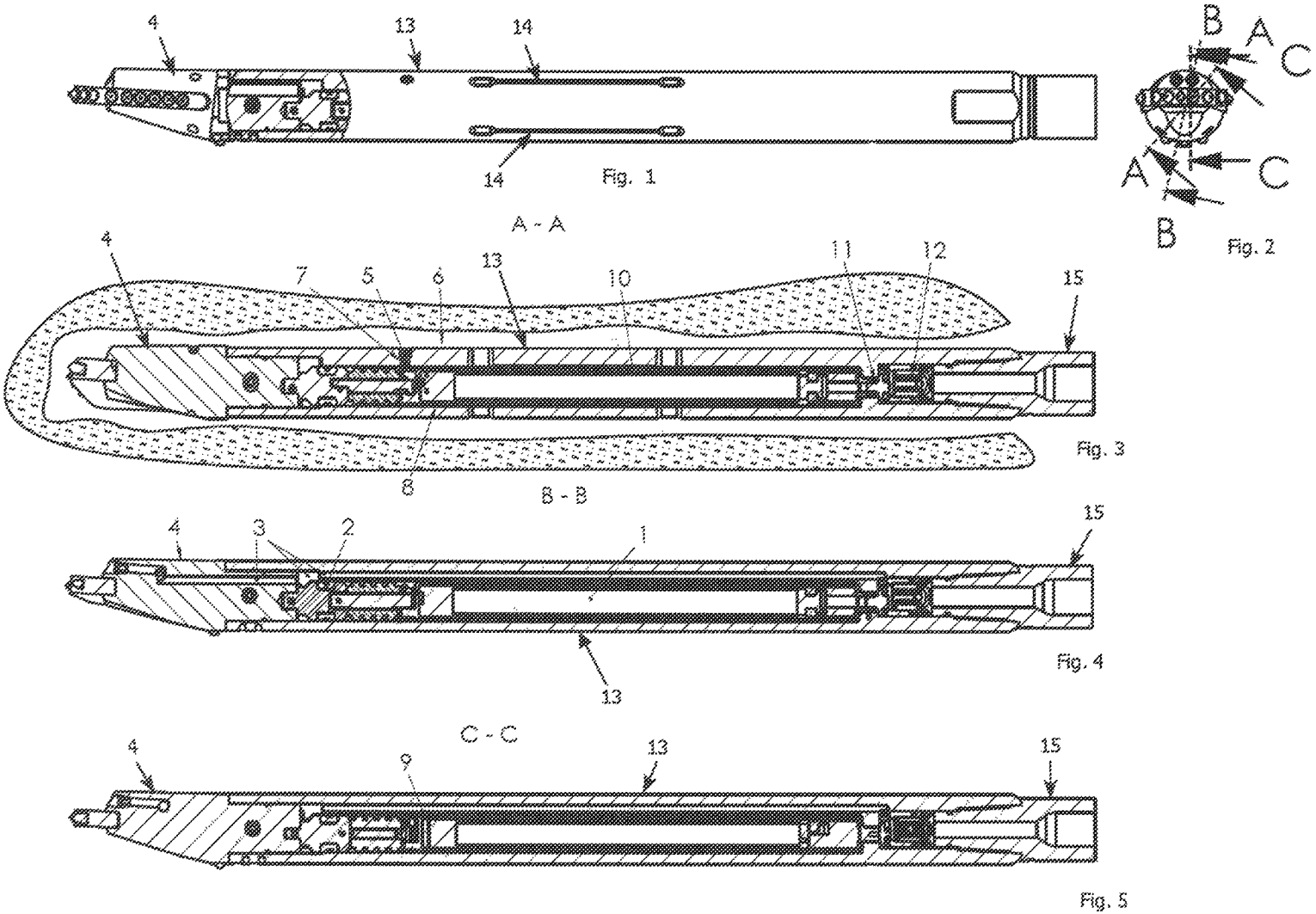
FIG. 1 shows a transmitter housing according to the invention connected to a drill head and a rod linkage, in a side view, in a partial section.
FIG. 2 shows a front view of the rod section shown in FIG. 1.
FIG. 3 shows a sectional view along line A-A from FIG. 2.
FIG. 4 shows a sectional view along line B-B from FIG. 2.
FIG. 5 shows a sectional view along line C-C according to FIG. 2.

FIG. 1 shows a rod section for the HDD. The rod section has a drill head 4 on the head side. A transmitter housing 13 is connected to the drill bit or drill head 4. In the exemplary embodiment, the drill head 4 is placed on the transmitter housing 13 and secured, with positive engagement against twisting, and in the longitudinal direction by means of a spring pin. Terminating at the transmitter housing 13 is a rod linkage 15, which is bolted thereto on the other end of the transmitter housing 13.

The transmitter housing 13 has a collector space 10 in which a pressure sensor 1 can be housed. The pressure sensor 1 can be designed as one unit with a locating probe and a transmitter for wireless transmission of the measured or determined values of the pressure sensor 1. There are longitudinal slots 14 in the area of the collector space 10 in the transmitter housing 13 for wireless transmission by the transmitter.

The pressure sensor 1 is separated from the drilling fluid intended for flushing, which is routed to the drill head 4 via a drilling fluid feed line 3, by means of a seal 2.

The collector space 10, and thus the pressure sensor 1, has a fluid connection with the exterior compartment—the drilling channel 6 via a bore 5. The fluid in the drilling channel 6 can thus enter the transmitter housing 13 via the bore 5 and a pressure sensor 1 is in contact with the fluid in the drilling channel 6 in order to measure that same pressure. The bore 5 extends transversely with respect to the longitudinal direction of the transmitter housing 13.

A filter 7, disposed between the bore 5 and the collector space 10 or the pressure sensor 1, prevents the penetration of contaminants.

There are seals 8 disposed in the transmitter housing 13, which ensure that the fluid in the drilling channel 6 only reaches a pressure surface 9 of the pressure sensor 1 disposed on the head-side end of the pressure sensor. An inlet opening of the collector space 10 is sealed off from the pressure sensor 1 via seals 8, so that only the pressure surface 9 of the pressure sensor 1 is exposed.

A jammed pressure sensor 1 can be pushed out with a threaded rod, or knocked out with a rod, for example, inserted into a closeable (e.g. via a closure 16) threaded bore 11.

A non-return valve 12 is disposed in the transmitter housing 13 at the end, so that the pressure in the drilling channel 6 can not drop, even during a rod change—if for example the rod linkage 15 is separated from the transmitter housing 13. The drilling fluid can flow in the direction of the drill head 4 via the drilling fluid feed line 3 and be routed to the drill head 4. Backflow through the rod, particularly through the transmitter housing 13, is not possible because of the non-return valve 12.

The invention claimed is:

1. A transmitter housing for a drilling device with a drilling fluid feed line, comprising:

a collector space;

a locating probe arranged in the collector space;

a transmitter arranged in the collector space and operatively connected to the locating probe;

a pressure sensor of the locating probe arranged in the collector space; and an aperture defined through a portion of the transmitter housing providing fluid communication between an external environment and a portion of the collector space for exposing a pressure sensing surface of the pressure sensor to the external environment, wherein a remaining portion of the collector space is not in fluid communication with the external environment via the aperture.

2. The transmitter housing according to claim 1, further comprising a solid matter filter disposed between the external environment and the collector space.

3. The transmitter housing according to claim 1, further comprising a non-return valve disposed at an end of the housing opposite an end for coupling to a drill head, and that permits the flow of fluid only in the direction towards the end for coupling to the drill head.

4. The transmitter housing according to claim 1, wherein the transmitter housing has a connection for a drill head.

5. The transmitter housing according to claim 1, wherein the drilling fluid feed line extends through the transmitter housing, and is separated from the collector space.

6. The transmitter housing according to claim 1, wherein the collector space extends in the direction of the longitudinal axis of the transmitter housing.

7. The transmitter housing according to claim 1, wherein the aperture from the external environment to the collector space has at least one section forming an angle to the longitudinal axis of the transmitter housing that is greater than 0° and less than 180°.

8. The transmitter housing according to claim 1, further comprising at least one seal surrounding a portion of the pressure sensor for preventing fluid communication between the remaining portion of the collector space and the external environment.

9. The transmitter housing according to claim 1, wherein the collector space includes a bore at an end opposite the aperture.

10. The transmitter housing according to claim 9, wherein the bore comprises a threaded bore.

11. The transmitter housing according to claim 10, further comprising a threaded closure configured to threadably engage with the threaded bore to close the bore.

* * * * *